US010255856B2

(12) United States Patent
Hyun et al.

(10) Patent No.: US 10,255,856 B2
(45) Date of Patent: Apr. 9, 2019

(54) DISPLAY DEVICE AND DRIVING METHOD OF THE SAME

(71) Applicant: Samsung Display Co., Ltd., Yongin-si, Gyeonggi-do (KR)

(72) Inventors: Chae Han Hyun, Yongin-si (KR); Seung Kyu Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 58 days.

(21) Appl. No.: 15/183,098

(22) Filed: Jun. 15, 2016

(65) Prior Publication Data

US 2017/0053596 A1 Feb. 23, 2017

(30) Foreign Application Priority Data

Aug. 18, 2015 (KR) ..... 10-2015-0116112

(51) Int. Cl.
*G09G 3/3258* (2016.01)

(52) U.S. Cl.
CPC ... *G09G 3/3258* (2013.01); *G09G 2320/0673* (2013.01)

(58) Field of Classification Search
CPC ..... G09G 3/2003; G09G 3/32–3/3241; G09G 3/3258; G09G 5/02; G09G 5/10; G09G 2300/0452; G09G 2320/0233; G09G 2320/0242; G09G 2320/0257; G09G 2320/0261; G09G 2320/0271; G09G 2320/0276; G09G 2320/0626; G09G 2320/0673; G09G 2330/028; G09G 2340/06
See application file for complete search history.

(56) References Cited

U.S. PATENT DOCUMENTS

2006/0097971 A1* 5/2006 Lee ..... G09G 3/3648 345/89
2010/0177126 A1* 7/2010 Inoue ..... G09G 3/3233 345/690
2011/0109661 A1* 5/2011 Lee ..... G09G 3/20 345/690
2014/0146090 A1* 5/2014 Oh ..... G09G 3/20 345/690
2014/0307002 A1* 10/2014 Lee ..... G09G 3/3233 345/690
2015/0187264 A1 7/2015 Pyo

FOREIGN PATENT DOCUMENTS

KR 10-2015-0010807 A 1/2015

* cited by examiner

*Primary Examiner* — Nathan Danielsen
(74) *Attorney, Agent, or Firm* — Innovation Counsel LLP

(57) ABSTRACT

In accordance with an embodiment, a display device may include a display panel including a plurality of pixels, a dimming controller for setting a first gamma correcting offset of a reference pixel among the plurality of pixels, setting a second gamma correcting offset of at least one pixel other than the reference pixel among the plurality of pixels, and generating a corrected gamma reference voltage per pixel using the first gamma correcting offset and the second gamma correcting offset and a data driver applying the corrected gamma reference voltage to each pixel of the display panel. According to an embodiment, there may be provided a display device capable of eliminating color shift by setting an offset for a gamma reference voltage per pixel and a driving method of the same.

15 Claims, 6 Drawing Sheets

DISPLAY DEVICE AND DRIVING METHOD OF THE SAME

CROSS-REFERENCE TO RELATED APPLICATION

This application claims priority to and the benefit of Korean Patent Application No. 10-2015-0116112, filed on Aug. 18, 2015, in the Korean Intellectual Property Office, the entire content of which is incorporated herein by reference in its entirety.

BACKGROUND

1. Field

Embodiments relate to a display device and a driving method of the same.

2. Description of the Related Art

Display devices today are needed for computer monitors, television, mobile phones, etc. Display devices which use digital data to display images include cathode-ray tube display, liquid crystal display (LCD), plasma display panel (PDP), organic light emitting device (OLED), etc. As display devices like these become high-resolution and large, the amount of data transmitted and its speed of transmission also increase.

One of the elements which contribute to better quality in a liquid crystal display device is setting gamma. Setting gamma is a correlation of display luminance and grayscale data, which may be defined by a gamma curve. Generally, display devices feature a gamma characteristic that the luminance of displayed images does not linearly increase with respect to input signal level applied to pixel. Here, gamma correction refers to converting light into electric signals in a camera and, when converting the converted electric signals back into images in the receiver, making adjustments necessary because the photoelectric conversion characteristics of the camera and the receiver are different, and because they are not linear. The relevant mathematical expressions here may be demonstrated with a curve called a gamma curve.

On the other hand, because an active matrix organic light emitting device uses the light emitted from its own organic light emitting layer, it is difficult to adjust the luminance of the whole of an organic light emitting display panel from outside, unlike a liquid crystal display device which can adjust whole luminance by adjusting the amount of light incident to the liquid crystal display panel by adjusting the voltage applied to the liquid crystal. Accordingly, a method to adjust the luminance of an organic light emitting display device by applying the impulse driving method in order to correct the motion blur phenomenon of the organic light emitting display device, that is, a method to dim an organic light emitting display device, is proposed.

SUMMARY

Embodiments relate to a display device capable of eliminating color shift by setting an offset, per pixel, on a gamma reference voltage and a driving method of the same.

Embodiments further relate to a method to compensate for a gamma reference voltage which sets a gamma reference voltage per pixel and a device related thereto.

Embodiments also relate to a method to prevent color shift during dimming, and a method to detect changes in characteristics of each pixel with reference to a reference pixel (for example, a center pixel) and set a gamma offset such that process deviation will have no effect during dimming and a device related thereto.

The technological goals which may be achieved herein are not limited to those mentioned above, and those not mentioned shall be understood clearly by a person of ordinary skill in the art from the description provided herein.

In accordance with an embodiment, a display device may include a display panel including a plurality of pixels, a dimming controller for setting a first gamma correcting offset of a reference pixel among the plurality of pixels, setting a second gamma correcting offset of at least one pixel other than the reference pixel among the plurality of pixels, and generating a corrected gamma reference voltage per pixel using the first gamma correcting offset and the second gamma correcting offset and a data driver applying the corrected gamma reference voltage to each pixel of the display panel.

The second gamma correcting offset may be determined according to characteristics of a thin film transistor of the at least one pixel.

The at least one pixel may be different from the reference pixel in color shift characteristics.

The dimming controller may set a gamma correcting offset for each pixel other than the reference pixel among the plurality of pixels and generate corrected gamma reference voltages per pixel using the gamma correcting offset per pixel.

The second gamma correcting offset may be a sum of the first gamma correcting offset and a value determined according to a thin film transistor characteristics curve of the at least one pixel.

The second gamma correcting offset may be determined by the following formula $$XCSO2 = \frac{(XG + XCSO)(GO255 - GO11)}{DG255 - DG11} + XCSO$$

wherein XCSO2 is the second gamma correcting offset, XCSO is the first gamma correcting offset, XG is a gamma reference voltage of a certain grayscale, DG255 is a gamma reference voltage of a reference pixel corresponding to 255 grayscale current, DG11 is a gamma reference voltage of a reference pixel corresponding to 11 grayscale current, GO255 is a difference between a gamma reference voltage of a reference pixel corresponding to 255 grayscale and the gamma reference voltage of the at least one pixel corresponding to 255 grayscale, GO11 is a difference between a gamma reference voltage of a reference pixel corresponding to 11 grayscale and the gamma reference voltage of the at least one pixel corresponding to 255 grayscale.

The reference pixel may be a center pixel located at a center of the display panel.

In accordance with an embodiment, a method of driving a display device may include setting a first gamma correcting offset of a reference pixel among a plurality of pixels included in a display panel, setting a second gamma correcting offset of at least one pixel other than the reference pixel among the plurality of pixels, generating a corrected gamma reference voltage per pixel using the first gamma correcting offset and the second gamma correcting offset and applying the corrected gamma reference voltage to each pixel of the display panel.

In accordance with an embodiment, a gamma reference voltage compensating device may set a first gamma correcting offset of a reference pixel among a plurality of pixels included in a display panel, set a second gamma correcting offset of at least one pixel other than the reference pixel among the plurality of pixels, generate a corrected gamma reference voltage per pixel using the first gamma correcting offset and the second gamma correcting offset, and apply the gamma reference voltage per pixel to the display panel.

According to an embodiment, there may be provided a display device capable of eliminating color shift by setting an offset for a gamma reference voltage per pixel and a driving method of the same.

Also, there may be provided a method to compensate for a gamma reference voltage for setting a gamma reference voltage offset for each pixel and a device related thereto.

Also, there may be provided a method to prevent color shift and a method to detect changes in characteristics of each pixel with reference to a reference pixel (for example, a center pixel) and set a gamma offset such that process deviation will have no effect during dimming and a device related thereto.

The effects which may be achieved herein are not limited to those mentioned above, and those not mentioned shall be understood clearly by a person of ordinary skill in the art from the description provided herein.

BRIEF DESCRIPTION OF THE DRAWINGS

Embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present between the two elements. Like reference numerals refer to like elements throughout.

DETAILED DESCRIPTION

Figure 1:
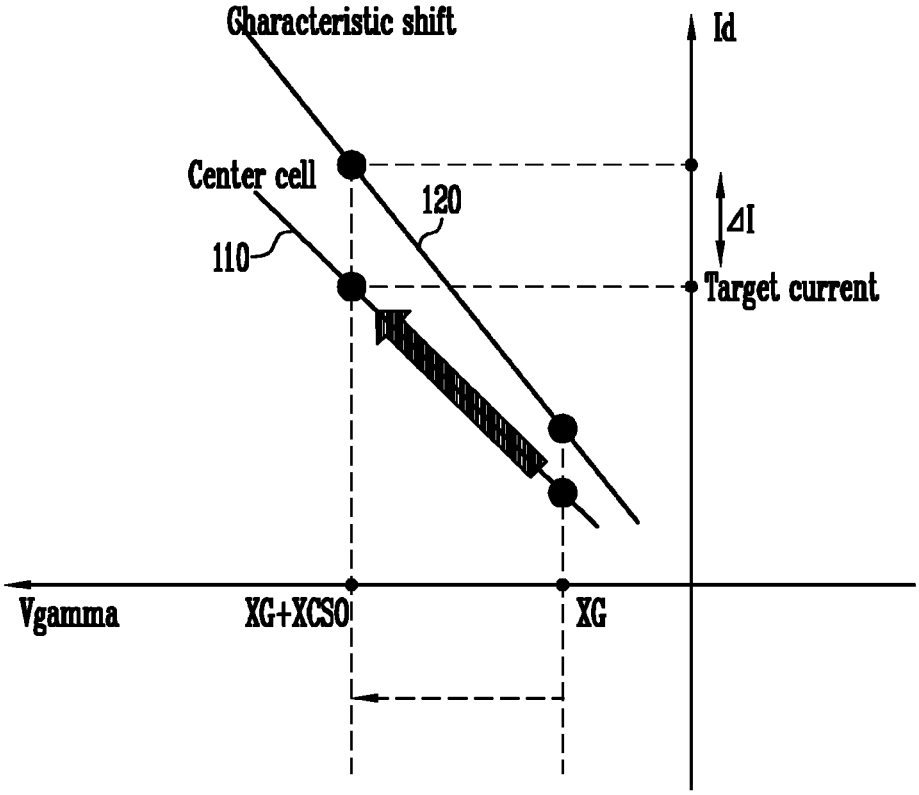
FIG. 1 illustrates an example of a change in luminance when a gamma offset is applied to a gamma reference voltage.

In the following detailed description, only certain exemplary embodiments of the present inventive concept have been shown and described, simply by way of illustration. As those skilled in the art would realize, the described embodiments may be modified in various different ways, all without departing from the spirit or scope of the present inventive concept. Accordingly, the drawings and description are to be regarded as illustrative in nature and not restrictive. In addition, it will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, a second element, component, region, layer or section could be termed a first element, component, region, layer or section, and so forth, without departing from the teachings of the present inventive concept.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the inventive concept. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2A:
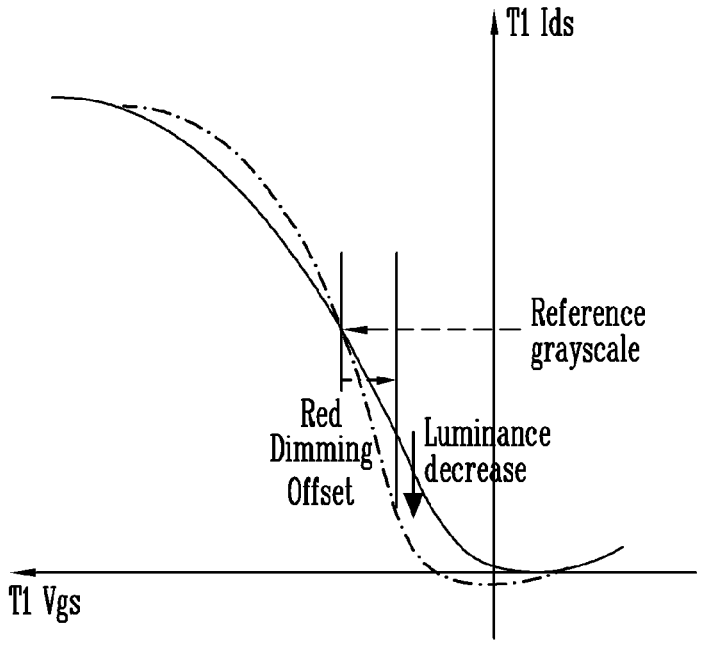
FIGS. 2A, 2B and 2C illustrate an example of a change in luminance due to a difference in dimming offsets for R, G, and B.
Figure 2B:
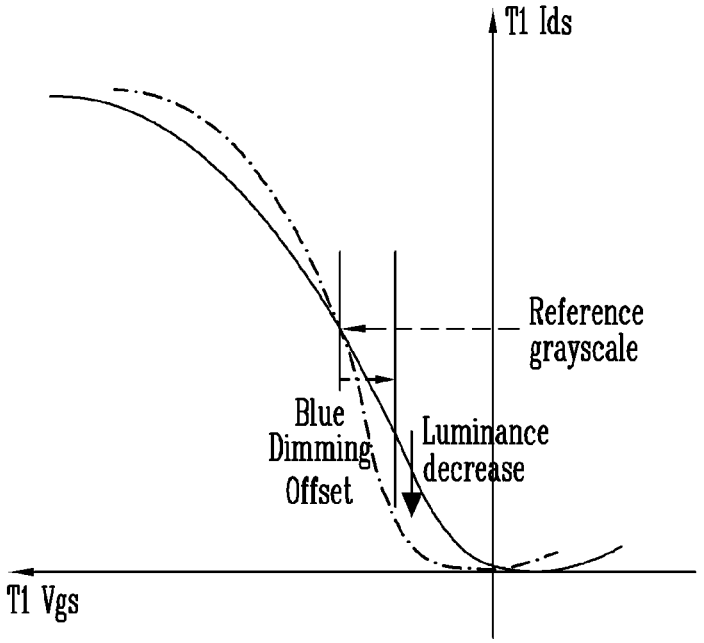
Figure 2C:
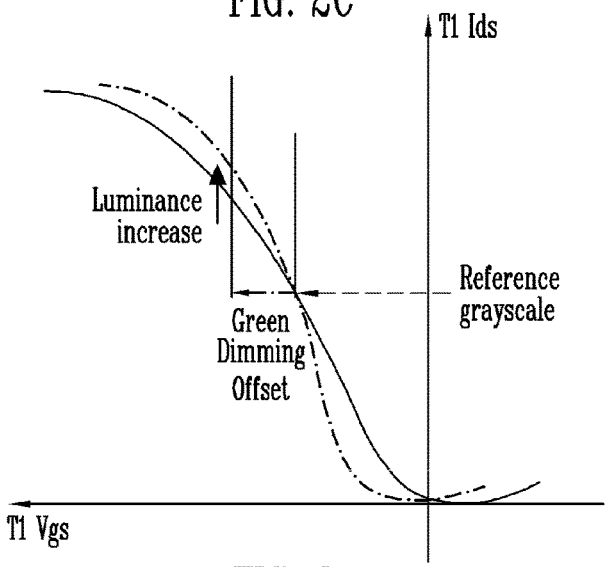
Figure 3:
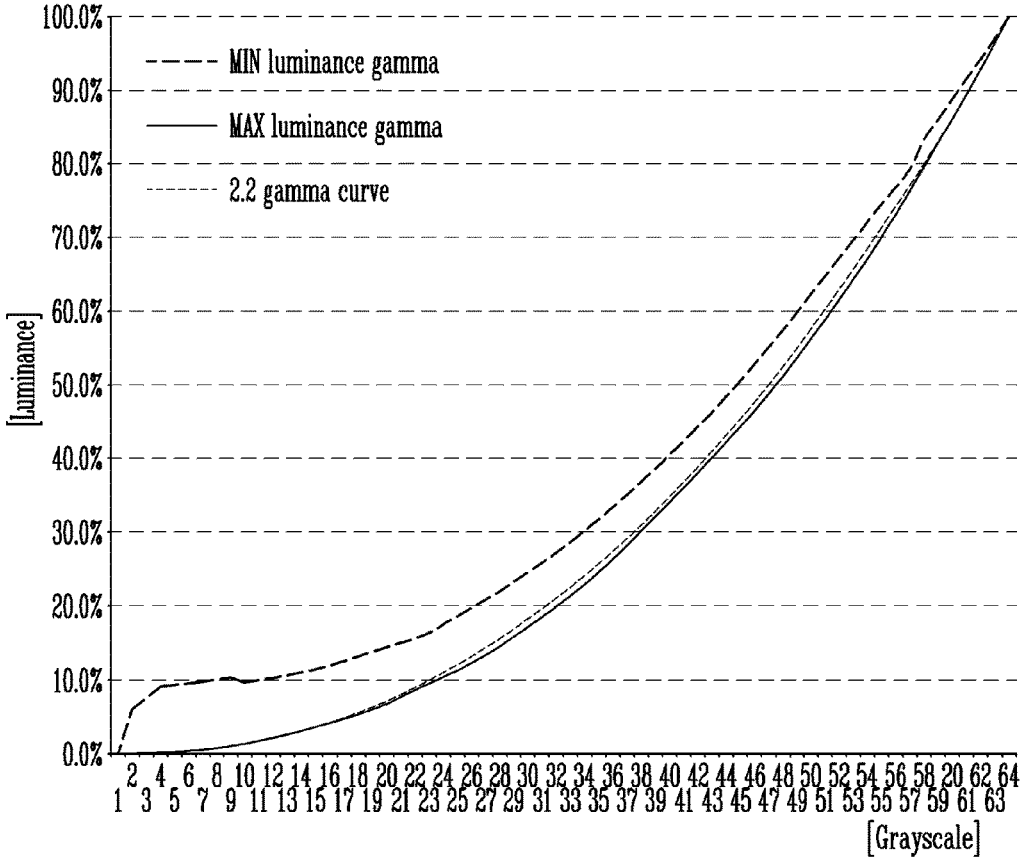
FIG. 3 illustrates an example of an increase in greenish visibility due to an increase in the low grayscale luminance of G pixel.

FIG. 1 illustrates an example of a change in luminance when a gamma offset is applied for a gamma reference voltage, FIGS. 2A to 2C illustrate an example of a change in luminance due to a difference in dimming offsets for R, and B, and FIG. 3 illustrates an example of an increase in greenish visibility due to an increase in the low grayscale luminance of G pixel.

Dimming refers to a technique to adjust the strength of light by controlling voltage or power applied to a light source. Resistor dimming (or data dimming) and a dimming method using impulse driving is commonly used to dim an organic light emitting diode (OLED) display. In resistor dimming, the OLED panel is dimmed by adjusting the electric current in an OLED element after adjusting the level of a voltage applied to each pixel. In dimming using impulse driving, an emission signal, not a data voltage, is adjusted to directly adjust the current in an OLED element, obtaining dimming effects by applying the impulse driving method, which applies black data between every two consecutive frames in order to eliminate motion blur. In other words, luminance may be adjusted by periodically turning the emission signal on and off.

Here, referring to the grayscale of a base luminance 113 nit as shown in Table 1, 2 nit gamma may be set when dimming.

TABLE 1

| 255G | AOR | Base | Call | Reference Gray Scale Shift | | | | | | | | |
|---|---|---|---|---|---|---|---|---|---|---|---|---|
| Luminance | % | Luminance | Gamma | V255 | V203 | V151 | V87 | V51 | V35 | V23 | V11 | V3 |
| 2 nit | 98.25 | 113 | 2.15 | 0 | 13 | 26 | 39 | 49 | 55 | 58 | 61 | 61 |

In Table 1, AOR(AID Off Ratio) % refers to a ratio of time when a pixel does not emit light for one period, Call Gamma refers to gamma used in the example shown in Table 1, and Reference Gray Scale Shift refers to a value shifted to a grayscale the most approximate to a luminance level of a selected dimming mode.

Depending on color shift in emission signal, a color offset for each emission signal may be set. Here, color shift refers to a phenomenon in which color changes according to conditions of light sources. A certain color may be emphasized in an image when the luminance of a certain color is increased. For example, but without limitation thereto, correction by lowering luminance may be needed due to the color shift in which the luminance of the certain color in low luminance is expressed higher than the target luminance.

In this case, in order to prevent color shift per gray scale, red R, green G, and blue B gamma offsets may be set as shown in Table 2 below for 2 nit dimming.

TABLE 2

| Color Shift Offset | | | | | | | | | | | | | | | | | | | | | | | |
|---|---|---|---|---|---|---|---|---|---|---|---|---|---|---|---|---|---|---|---|---|---|---|---|
| 255 | | | 203 | | | 151 | | | 87 | | | 51 | | | 35 | | | 23 | | | 11 | | |
| R | G | B | R | G | B | R | G | B | R | G | B | R | G | B | R | G | B | R | G | B | R | G | B |
| −9 | 2 | −10 | −5 | 1 | −5 | −7 | 1 | −8 | −15 | 6 | −16 | −11 | 8 | −17 | −8 | 6 | −14 | −5 | 6 | −13 | −10 | 7 | −16 |

As shown in FIG. 1, when a gamma offset (color shift offset) correction value for a reference pixel 110 is set, for example, as shown in Table 2, the same gamma offset may be applied to all pixels. Here, in accordance with an embodiment, the reference pixel 110 may refer to a center pixel located at the center of a display panel.

In FIG. 1, hereinafter, the gamma reference voltage of a certain grayscale of each color is called RG, GG, and BG, respectively, and commonly called XG. Herein, XG may refer to any one of RG, GG, and BG. The color shift offset for each color corresponding to the gamma reference voltage of the grayscale is each called RCSO, GCSO, and BCSO, and commonly called XCSO. Herein, XCSO may refer to any one of RCSO, GCSO, and BCSO. A characteristic shift pixel, which is a pixel other than the reference pixel, may refer to a pixel with a color shift characteristic different from that of the reference pixel among the pixels on the display panel. When the reference pixel 110 is a center pixel, a center pixel 110 may refer to a pixel located at the center of the display panel. Hereinafter, an explanation is given as to when the reference pixel is the center pixel.

In the case of a center pixel 110 as shown in FIG. 1, XCSO may be applied as the gamma offset value to the gamma reference voltage value XG of a certain grayscale, to compensate for color shift. As a result, the luminance of the center pixel 110 may increase to the value shown in FIG. 1 as a target current. In the case of a characteristic shift pixel 120, when the same XCSO gamma offset value which is the same as that of the center pixel 110 is applied to the gamma reference voltage value XG of a certain grayscale, the current of the characteristic shift pixel 120 may increase by a certain value ΔI compared to target current value.

Since gamma offset for compensation of color shift is set using a reference pixel at the time of development, e.g., the center pixel 110, when characteristics of a thin film transistor (TFT) are changed during mass production, color shift characteristics of the characteristic shift pixel 120 may be different from those of the center pixel 110. Therefore, when a gamma offset value of the reference pixel is applied to the other pixels such as a character shift pixel 120, as in FIG. 1, because color shift characteristics of the characteristic shift pixel 120 differ from those of the reference pixel, targeted luminance may not be achieved in the characteristic shift pixel 120.

FIG. 2A illustrates differences in luminance due to differences in dimming offsets for R. FIG. 2B illustrates differences in luminance due to differences in dimming offsets for B. FIG. 2C illustrates differences in luminance due to differences in dimming offsets for G.

As shown in FIG. 2A, a red dimming offset is applied, luminance may be decreased as shown as the dotted line compared to the reference grayscale. Also, when, as shown in FIG. 2B, a blue dimming offset is applied, luminance may be decreased as shown as the dotted line compared to the reference grayscale. On the other hand, referring to FIG. 2C, when a green dimming offset is applied, luminance may be increased as shown as the dotted line compared to the reference grayscale.

FIG. 3 illustrates a minimum (MIN) luminance gamma curve, a maximum (MAX) luminance gamma curve, and a 2.2 gamma curve. Although the MAX luminance gamma curve almost coincides with the 2.2 gamma curve, the MIN luminance gamma curve may be very different from the 2.2 gamma curve in terms of low gray. As such, for a green pixel, because 2 bit low grayscale luminance may increase, the panel may have greenish visibility. In addition, as exemplified in [Table 2] above, a gamma offset correction value of green may be higher than that of red or blue. Therefore, as shown in FIGS. 2A to 2C, a TFT slope of green, i.e., a slope of a driving voltage-current may be greater than that of red or blue. Therefore, 2 nit grayscale luminance of a green pixel may increase and cause the greenish visibility of a display panel to increase.

When a gamma offset of a reference pixel (for example, a center pixel) is applied to all the pixels of a display panel, target luminance may not be achieved precisely when the characteristics of the color shift are different from one another. Therefore, for a display device in accordance with an embodiment, a gamma offset value may be set differently for each pixel in order to eliminate color shift.

Figure 4A:
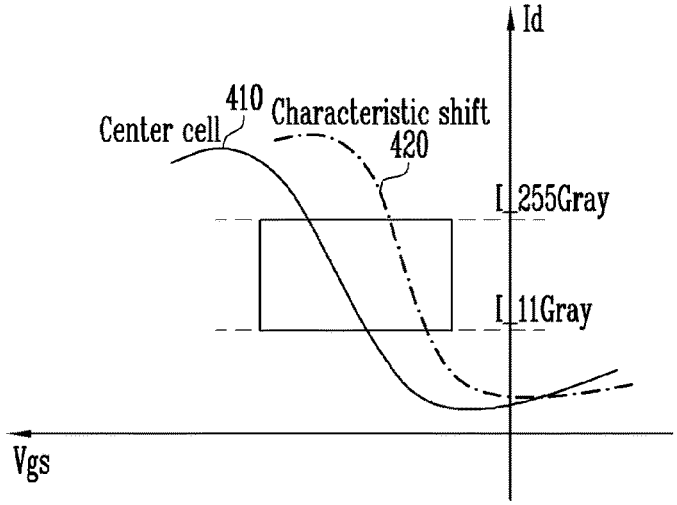
FIGS. 4A and 4B illustrate an example of a gamma reference voltage and luminance in accordance with an embodiment.
Figure 4B:
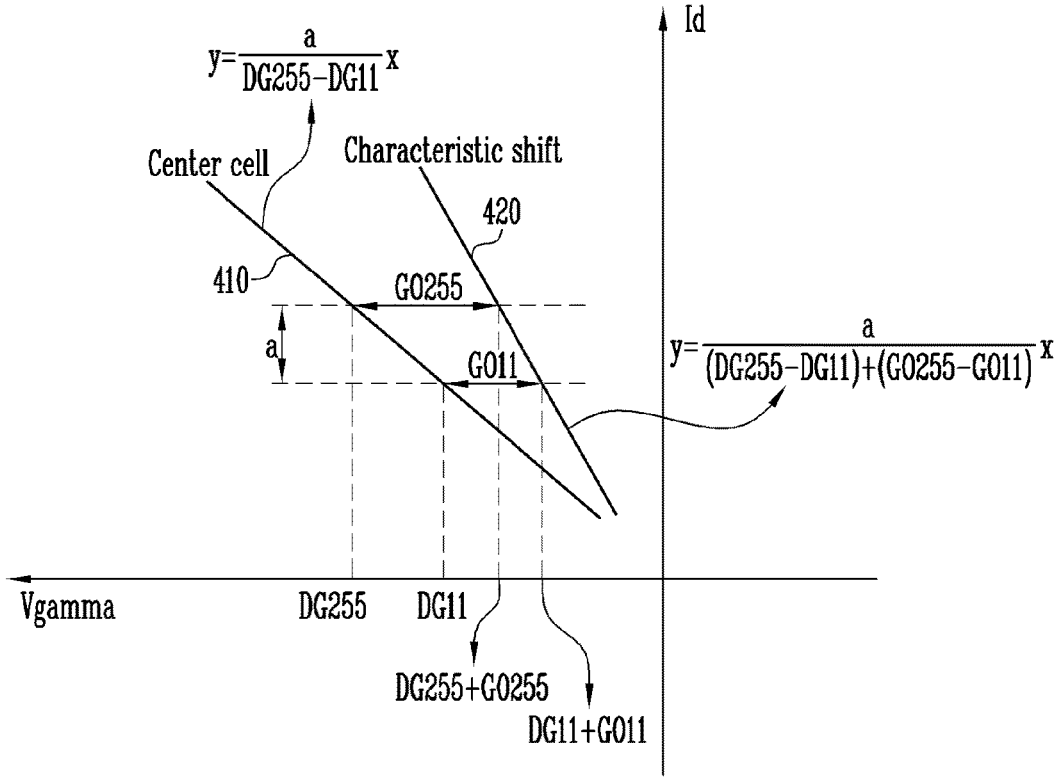
Figure 5:
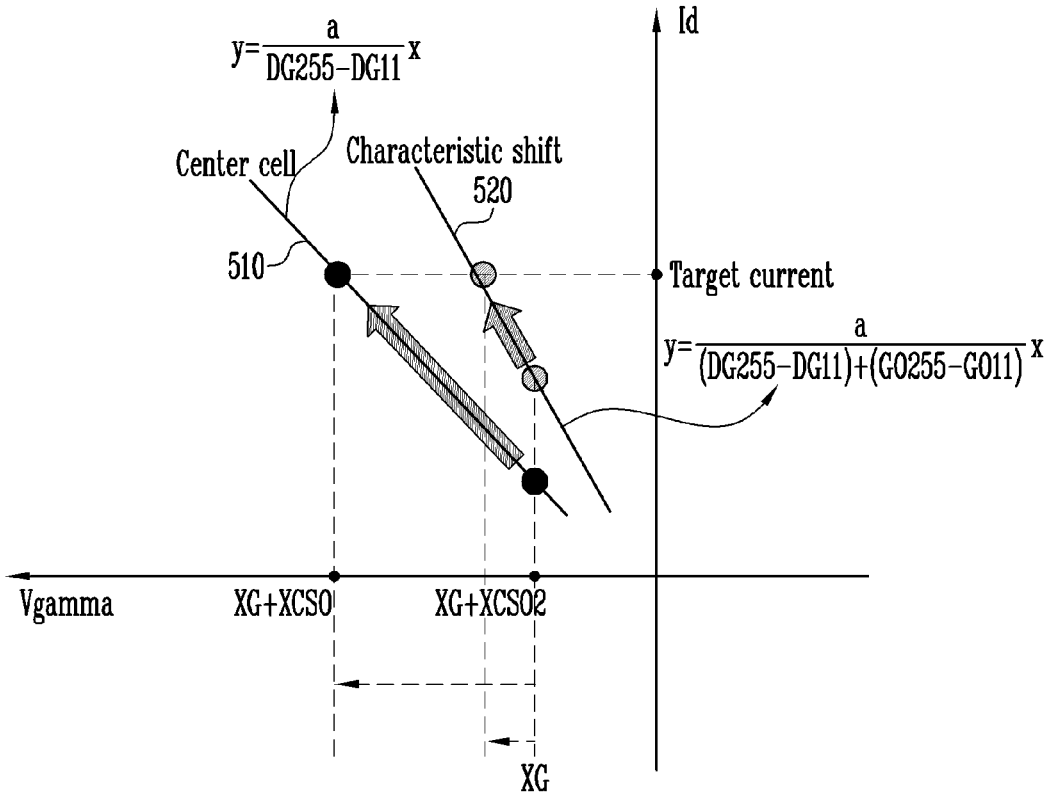
FIG. 5 illustrates an example of a method to get the value of a gamma offset per pixel in accordance with an embodiment.

FIGS. 4A and 4B illustrate an example of a gamma reference voltage and luminance in accordance with an embodiment. FIG. 5 illustrates an example of a method to determine the gamma offset for each pixel in accordance with an embodiment.

FIG. 4A illustrates the relationship between pixel driving voltage (Vgs) and current (Id) when the pixel driving transistor is, for example, a PMOS transistor. In this case, as shown, the current-voltage characteristic of a reference pixel 410 and a characteristic shift pixel 420 may differ. Here, the driving voltage for 255 grayscale current of the reference pixel 410 and the driving voltage for 255 grayscale current of the characteristic shift pixel 420 may differ. And the driving voltage for 11 grayscale current of the reference pixel 410 and the driving voltage for 11 grayscale current of the characteristic shift pixel 420 may differ. Here, in accordance with an embodiment, the reference pixel 410 may be a center pixel located at the center of a display panel.

FIG. 4B illustrates the relationship between a gamma reference voltage (V gamma) and current (Id). Here, the relationship between the gamma reference voltage and the current of a reference pixel 410 may differ from that between the gamma reference voltage and current of a characteristic shift pixel 420. Here, the gamma reference voltage of the reference pixel 410 may be called a default gamma DG. And the default gamma corresponding to 255 grayscale current may be called DG255, and that corresponding to 11 grayscale current may be called DG11. Also, the difference between the gamma reference voltage of a characteristic shift pixel 420 and the gamma reference voltage of a reference pixel 410, regarding the same current, may be called a gamma offset GO. And the gamma offset corresponding to 255 grayscale may be called GO255, and the gamma offset corresponding to 11 grayscale may be called GO11. Therefore, the gamma reference voltage of the characteristic shift pixel 420 corresponding to 255 grayscale current may be DG255+GO255, and the gamma reference voltage of the characteristic shift pixel corresponding to 11 grayscale current may be DG11+GO11.

Here, when the difference between 255 grayscale current and 11 grayscale current is called 'a', the relationship between the gamma reference voltage and current of the reference voltage 410 may be defined as Formula 1 below, and the relationship between the gamma reference voltage and current of a characteristic preparation pixel 420 may be defined as Formula 2 below.

$$y = \frac{a}{DG255 - DG11}x \qquad \text{Formula 1}$$

$$y = \frac{a}{(DG255 - DG11) + (GO255 - GO11)}x \qquad \text{Formula 2}$$

FIG. 5 illustrates the relationship between gamma reference voltage and current. Here, the relationship between the gamma reference voltage and current of a reference pixel 510 may differ from that between the gamma reference voltage and current of a characteristic shift pixel 520. And the relationship between the gamma reference voltage and current of the reference pixel 510 may be shown in Formula 1, and the relationship between the gamma reference voltage and current of the color shift pixel 520 may be shown in Formula 2.

Here, as described above, a gamma reference voltage for a certain grayscale of each color, may be RG, GG, and BG, and may be commonly called XG for convenience in illustration. Here, XG may refer to any one of RG, GG, and BG. And the color shift offset for each color corresponding to the gamma reference voltage of the grayscale of the reference pixel 510 may be called RCSO, GCSO, and BCSO, and may be commonly called XCSO for convenience in illustration. Here, in accordance with an embodiment, the reference pixel 510 may be a center pixel. For ease of illustration, the XCSO may be called a first gamma correcting offset, or center gamma correcting offset, or center pixel gamma correcting offset, or reference pixel gamma correcting offset. Here, XCSO may refer to any one of RCSO, GCSO, and BCSO. Also, the color shift correcting offset of each color for the gamma reference voltage of the grayscale of the characteristic shift pixel 520 may be called RCSO2, GCSO2, or BCSO2, and, for convenience in illustration, may be commonly called XCSO2. Here, XCSO2 may refer to any one of RCSO2, GCSCO2, and BCSO2. Also, for ease of illustration, the XCSO2 may be called a second gamma correcting offset, characteristic shift cell gamma correcting offset, or gamma correcting offset per cell, or gamma correcting offset per pixel, or characteristic shift pixel gamma correcting offset.

In the case of the reference pixel 510, XCSO may be applied, as the value of the gamma offset in order to prevent color shift per grayscale, to the gamma reference voltage value XG of a certain grayscale. In this case, the gamma reference voltage of the grayscale of the reference pixel 510 may be XG+XCSO, and accordingly, current may increase to become a target current value. In the case of the characteristic shift pixel 520, XCSO2 may be applied, as the value of the characteristic shift pixel gamma offset in order to prevent color shift per grayscale, to a certain grayscale gamma reference voltage XG. In this case, the gamma reference voltage of the grayscale of the characteristic shift pixel 520 may be XG+XCSO2, and accordingly, current may increase to become a target current value.

In other words, the gamma correcting offset for the reference pixel 510 and the characteristic shift pixel 520 each may be applied to the gamma reference voltage, such that the current value for a certain grayscale stays the same, that is, such that luminance stays the same.

The relationship between the characteristic shift pixel gamma correcting offset and the reference pixel gamma correcting offset shall be examined.

A current I1 of the center pixel having the reference pixel gamma correcting offset XCSO for a certain luminance may be equal to the value of Formula 3 which substitute XG+XCSO for x of Formula 1.

$$I_1 = \frac{a(XG + XCSO)}{DG255 - DG11} \quad \text{Formula 3}$$

Also, a current I2 of the character shift pixel 520 having the reference pixel gamma correcting offset XCSO2 for a certain luminance may be equal to the value of Formula 4 which substitute XG+XCSO2 for x of Formula 2.

$$I_2 = \frac{a(XG + XCSO2)}{(DG255 - DG11) + (GO255 - GO11)} \quad \text{Formula 4}$$

The characteristic shift pixel gamma correcting offset XCSO2 may be set in such a way that the reference pixel gamma correcting current I1 is the same as the characteristic shift pixel gamma correcting current I2 (I1=I2).

Accordingly, the relationship between the characteristic shift pixel gamma correcting offset XCSO2 and the reference pixel gamma correcting offset XCSO may be set in accordance with Formula 5 to Formula 7.

$$\frac{a(XG + XCSO)}{DG255 - DG11} = \frac{a(XG + XCSO2)}{(DG255 - DG11) + (GO255 - GO11)} \quad \text{Formula 5}$$

$$(XG + XCSO2)(DG255 - DG11) = (XG + XCSO)\{(DG255 - DG11) + (GO255 - GO11)\} \quad \text{Formula 6}$$

$$XCSO2 = \frac{(XG + XCSO)(GO255 - GO11)}{DG255 - DG11} + XCSO \quad \text{Formula 7}$$

Referring to Formula 7, the characteristic shift pixel gamma correcting offset XCSO2 may be a value equal to the reference pixel gamma correcting offset XCSO plus the value reflecting a TFT characteristics curve per pixel. Here, the value reflecting the TFT characteristics curve per pixel may be a value equal to the sum of the gamma reference voltage XG and the reference pixel gamma correcting offset, multiplied by the difference between the gamma offset GO255 corresponding to 255 grayscale and the gamma offset GO11 corresponding to 11 grayscale, and then divided by the difference between the default gamma DG255 corresponding to 255 grayscale current and the default gamma DG11 corresponding to 11 grayscale current.

As above, in a display device in accordance with an embodiment, a gamma correcting offset per pixel may be set, reflecting the TFT characteristics curve per pixel. And dimming may be done by applying the gamma correcting offset per pixel to the gamma reference voltage.

Figure 6:
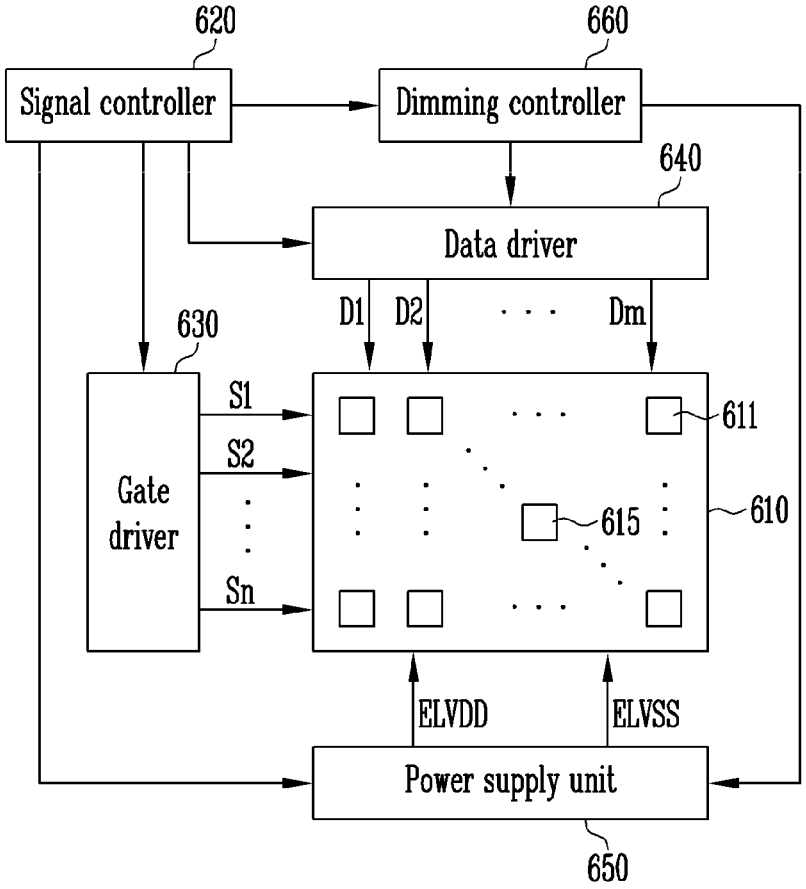
FIG. 6 illustrates an example of a component block diagram of a display device in accordance with an embodiment.

FIG. 6 illustrates an example of a component block diagram of a display device in accordance with an embodiment.

Referring to FIG. 6, a display device in accordance with an embodiment may include a display panel 610 including a plurality of pixels 611 and 615, a gate driver 630 which transmits a plurality of scan signals to the display panel 610, a data driver 640 which transmits a plurality of data signals to the display panel 610, a power supply unit 650 which supplies driving voltage, for example a first power voltage ELVDD and a second power voltage ELVSS, and a signal controller 620 which supplies a plurality of control signals which control the gate driver 630, the data driver 640, and the power supply unit 650. Furthermore, the display device may further include a dimming controller 660, and the signal controller 620 may supply a control signal to the dimming controller 660.

The display panel 610 may be a panel on which the plurality of pixels 611 and 615 are arranged in matrix, and each pixel may include an organic light emitting diode OLED which emits light in response to the flow of the driving current in accordance with a data signal transmitted from the data driver 640. Depending on the driving method of the organic light emitting diode, the display device may be classified as passive matrix OLED (PMOLED) or active matrix OLED (AMOLED). Here, in accordance with an embodiment, the display device may be AMOLED.

A plurality of scan lines S1 to Sn which form in row direction in the plurality of pixels 611 and 615 included in the display panel 610 and transmit scan signals from the gate driver 630, and a plurality of data lines D1 to Dm which form in column direction and transmit data signals from the data driver 640 may be arranged.

Among the plurality of pixels 611 and 615, a pixel located at the cross section of j pixel row and k pixel column may be connected to one corresponding scan line Sj and one corresponding data line Dk. However, this is only an example, and embodiments are not limited to this constitution and structure. For example, the gate driver 630 may be realized with a plurality of drivers.

The pixels 611 and 615 may include a pixel circuit which supplies current in accordance with corresponding data signals to an organic light emitting diode, and the organic light emitting diode may emit light of a certain luminance in accordance with the supplied current. Here, the first power voltage ELVDD and the second power voltage ELVSS necessary for the operation of the display panel 610 may be transmitted from the power supply unit 650.

The gate driver 630 may be a means to apply a plurality of scan signals to the display panel 610, be connected to the plurality of scan lines S1 to Sn, and transmit the plurality of scan signals to the corresponding scan lines. The gate driver 630, in accordance with gate driving control signals supplied from the signal controller 620, may generate scan signals and transmit them to the scan lines connected to the rows of the plurality of pixels 611 and 615 included in the display panel 610.

The dimming controller 660 may set gamma offset values in accordance with color shifts of a plurality of light emitting signals. Here, the dimming controller 660 may set a gamma correcting offset per pixel, reflecting the TFT characteristics curve per pixel, for each of the pixels 611 and 615 of the display panel 610, that is, each of the plurality of pixels 611 and 615. In other words, a gamma correcting offset for the reference pixel 615 and each of the pixels 611 other than the reference pixel 615 may be set. No further detailed explanations will follow regarding a setting method of the gamma correcting offset per pixel because it is described with reference to FIGS. 4 and 5 and in related parts. And the dimming controller 660 may generate corrected gamma reference voltages by applying the gamma correcting offset value per pixel to the gamma reference voltage per pixel. The dimming controller 660 may also transmit the corrected gamma reference voltages to the data driver 640. In addition, the dimming controller 660 may transmit control signals to the power supply unit 650 such that driving voltage may be supplied to the display panel 610 in accordance with the corrected gamma reference voltage. The dimming controller 660 may be called a gamma reference voltage compensation device and may include any device which sets a gamma correcting offset per pixel 611 and 615 and corrects a gamma reference voltage using the value of the offset.

The data driver 640 may generate corrected gamma reference voltages supplied from the dimming controller 660, generate a plurality of data voltages from image data signals transmitted from the signal controller 620, and transmit the voltages to the plurality of data lines D1 to Dm connected to the display panel 610. The driving of the data driver 640 may be operated by driving control signals supplied from the signal controller 620. As a result, the display panel 610 may display images with color shift per pixel eliminated.

In accordance with an embodiment, hardware-wise, the gate driver 630, the data driver 640, the signal controller 620, the dimming controller 660, etc. may be implemented on a display driver IC.

The plurality of pixels included in the display panel 610 may receive corresponding scan signals, cause organic light emitting diodes to emit light, and, accordingly, display image with data voltage corresponding to data signal.

As above, a display device in accordance with an embodiment may not be subject to process deviation during dimming by detecting the characteristic shift of each pixel compared to the TFT characteristics of a center pixel, setting gamma correcting offsets, and correcting the gamma reference voltage per pixel. Furthermore, color shift may be prevented during dimming.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present inventive concept as set forth in the following claims.

What is claimed is:

1. A display device comprising:

a display panel including a plurality of pixels;

a dimming controller configured to set a first gamma correcting offset of a reference pixel among the plurality of pixels, set a second gamma correcting offset of at least one pixel other than the reference pixel among the plurality of pixels, and generate a corrected gamma reference voltage per pixel using the first gamma correcting offset and the second gamma correcting offset; and a data driver applying the corrected gamma reference voltage to each pixel of the display panel.

2. The display device as claimed in claim 1, wherein the second gamma correcting offset is determined according to characteristics of a thin film transistor of the at least one pixel.

3. The display device as claimed in claim 1, wherein the at least one pixel is different from the reference pixel in color shift characteristics.

4. The display device as claimed in claim 1, wherein the dimming controller sets a gamma correcting offset for each pixel other than the reference pixel among the plurality of pixels and generates corrected gamma reference voltages per pixel using the gamma correcting offset per pixel.

5. The display device as claimed in claim 1, wherein the second gamma correcting offset is a sum of the first gamma correcting offset and a value determined according to a thin film transistor characteristics curve of the at least one pixel.

6. The display device as claimed in claim 1, wherein the second gamma correcting offset is determined by the following formula $$XCSO2 = \frac{(XG + XCSO)(GO255 - GO11)}{DG255 - DG11} + XCSO$$

wherein XCSO2 is the second gamma correcting offset, XCSO is the first gamma correcting offset, XG is a gamma reference voltage of a certain grayscale, DG255 is a gamma reference voltage of a reference pixel corresponding to a current required to display a gray scale of 255, DG11 is a gamma reference voltage of a reference pixel corresponding to a current required to display a gray scale of 11, GO255 is a difference between a gamma reference voltage of a reference pixel corresponding to 255 grayscale and a gamma reference voltage of the at least one pixel, GO11 is a difference between a gamma reference voltage of a reference pixel corresponding to 11 grayscale and the gamma reference voltage of the at least one pixel.

7. The display device as claimed in claim 1, wherein the reference pixel is a center pixel located at a center of the display panel.

8. A method of driving a display device comprising:

setting a first gamma correcting offset of a reference pixel among a plurality of pixels included in a display panel;

setting a second gamma correcting offset of at least one pixel other than the reference pixel among the plurality of pixels;

generating a corrected gamma reference voltage per pixel using the first gamma correcting offset and the second gamma correcting offset; and applying the corrected gamma reference voltage to each pixel of the display panel.

9. The method of driving the display device as claimed in claim 8, wherein the second gamma correcting offset is determined according to characteristics of a thin film transistor of the at least one pixel.

10. The method of driving the display device as claimed in claim 8, wherein the at least one pixel is different from the reference pixel in color shift characteristics.

11. The method of driving the display device as claimed in claim 8, wherein the generating the corrected gamma reference voltage comprises setting a gamma correcting offset for each pixel other than the reference pixel among the plurality of pixels and generating corrected gamma reference voltages per pixel using the gamma correcting offset per pixel.

12. The method of driving the display device as claimed in claim 8, wherein the second gamma correcting offset is a sum of the first gamma correcting offset and a value that is determined according to a thin film transistor characteristics curve of the at least one pixel.

13. The method of driving the display device as claimed in claim 8, wherein the second gamma correcting offset is determined by the following formula $$XCSO2 = \frac{(XG + XCSO)(GO255 - GO11)}{DG255 - DG11} + XCSO$$

wherein XCSO2 is the second gamma correcting offset, XCSO is the first gamma correcting offset, XG is a gamma reference voltage of a certain grayscale, DG255 is a gamma reference voltage of a reference pixel corresponding to a current required to display a gray scale of 255, DG11 is a gamma reference voltage of a reference pixel corresponding to a current required to display a gray scale of 11, GO255 is a difference between a gamma reference voltage of a reference pixel corresponding to 255 grayscale and a gamma reference voltage of the at least one pixel, GO11 is a difference between a gamma reference voltage of a reference pixel corresponding to 11 grayscale and the gamma reference voltage of the at least one pixel.

14. The method of driving the display device as claimed in claim 8, wherein the reference pixel is a center pixel located at a center of the display panel.

15. A method of driving a gamma reference voltage compensating device comprising:

setting a first gamma correcting offset of a reference pixel among a plurality of pixels included in a display panel, setting a second gamma correcting offset of at least one pixel other than the reference pixel among the plurality of pixels, generating a corrected gamma reference voltage per pixel using the first gamma correcting offset and the second gamma correcting offset, and applying the gamma reference voltage per pixel to the display panel.

* * * * *